US005695135A

United States Patent [19]

Aikawa

[11] Patent Number: 5,695,135

[45] Date of Patent: Dec. 9, 1997

[54] REFINER WITH EASILY ATTACHABLE DISC

[75] Inventor: Yoshihiko Aikawa, Shizuoka, Japan

[73] Assignee: Aikawa Iron Works Co., Ltd., Shizuoka, Japan

[21] Appl. No.: 607,775

[22] Filed: Feb. 27, 1996

[51] Int. Cl.[6] ..... B02C 7/14

[52] U.S. Cl. ..... 241/261.2; 241/285.2; 241/297

[58] Field of Search ..... 241/261.2, 261.3, 241/285.2, 285.3, 297, 298

[56] References Cited

U.S. PATENT DOCUMENTS

| | | | |
|---|---|---|---|
| 2,539,775 | 1/1951 | Gordon | 241/285.2 X |
| 4,736,897 | 4/1988 | Reemet et al. | 241/285.2 X |
| 5,520,344 | 5/1996 | Fey et al. | 241/285.3 X |

FOREIGN PATENT DOCUMENTS

| | | | |
|---|---|---|---|
| 1057417 | 5/1959 | Germany | 241/285.2 |

*Primary Examiner*—Mark Rosenbaum
*Attorney, Agent, or Firm*—Kanesaka & Takeuchi

[57] ABSTRACT

A refiner for crushing materials is formed of a main portion, a cover openably provided to the main portion, a partition of the main portion, a rotating shaft provided in the main portion, a circular plate provided to the rotating shaft, annular rotating discs provided to both sides of the circular plate, and fixed discs provided to the cover and the partition, respectively. The refiner also includes a cylinder for holding the rotating shaft, and a feed screw shaft for moving the rotating shaft along an axis thereof. When the cover is opened and the circular plate is moved, the fixed discs and the rotating discs can be easily and quickly attached or detached.

7 Claims, 3 Drawing Sheets

REFINER WITH EASILY ATTACHABLE DISC

BACKGROUND OF THE INVENTION AND RELATED ART STATEMENT

The present invention relates to a grinder or refiner for crushing materials.

A conventional grinder or refiner is formed of a main portion having a partition and a rotating shaft; a cover facing the main portion and openably provided along the rotating shaft; rotating discs provided on both sides of a circular plate of the rotating shaft; and fixed discs provided to the cover and the partition, respectively.

When the rotating discs and the fixed discs are exchanged, after the cover is moved along the rotating shaft to open, the rotating shaft is slightly moved along the axis thereof to form spaces among the partition, the circular plate and the cover. Then, the rotating discs or the fixed discs are attached or detached.

Another conventional refiner is formed of a main portion having a partition and a rotating shaft; a cover openably provided to the main portion through a hinge; a circular plate provided between the cover and the partition to be detachable from the rotating shaft, and integrally rotated when detached; annular rotating discs provided on both sides of the circular plate; and fixed discs respectively facing the rotating discs and provided to the cover and the partition. Incidentally, the circular plate is connected to the main portion through a hinge.

In the another conventional refiner, the cover is opened through a hinge as a supporting point, and at the same time the circular plate is opened through the hinge as the supporting point to an opposite side of the cover to form a space, so that the rotating discs and fixed discs are attached or detached.

In the former conventional refiner, since the cover is moved along the rotating shaft, the fixed discs and the rotating discs can be attached or detached at a relatively narrow space. However, since a moving amount of the circular plate corresponds to a length required for adjusting the space between the discs, the space formed between the partition and the circular plate is very narrow, and the rotating disc facing the partition and the fixed disc of the partition are very hard to be attached and detached to thereby delay the attaching and detaching operations. Thus, there has been a problem of poor workability.

In the later conventional refiner, since both the cover and the circular plate are opened to both sides of the main portion, the problem in the former conventional refiner can be solved. However, since the spaces for opening the cover and the circular plate are required on both sides of the main portion, the attaching and detaching operations can only be carried out at a wide space. Also, frequent exchange of the discs may be required, i.e. every two months in the earliest cases, and whenever the exchange is carried out, the circular plate has to be detached from and attached to the rotating shaft, so that the rotating shaft is damaged to thereby lower accuracy of the rotating shaft.

Accordingly, one object of the invention is to provide a grinder or refiner, wherein even in a narrow space, a rotating disc facing a partition and a fixed disc of the partition can be easily attached or detached.

Another object of the invention is to provide a refiner as stated above, wherein damages of the rotating shaft due to exchange of the discs are prevented and accuracy of the rotating shaft can be maintained.

A further object of the invention is to provide a refiner as stated above, wherein the connecting portion between a supply passage and a crushing chamber can be easily cleaned.

A still further object of the invention is to provide a refiner as stated above, wherein good workability for opening and closing the cover can be obtained.

A still further object of the invention is to provide a refiner as stated above, wherein spaces can be formed between the cover and the circular plate and between the circular plate and the partition without being disturbed by the cover.

Further objects and advantages of the invention will be apparent from the following description of the invention.

SUMMARY OF THE INVENTION

According to a first aspect of the invention, a refiner comprises a main portion having a partition; a cover attached to the main portion and forming a crushing chamber together with the partition; a rotating shaft extending through the main portion to the crushing chamber; a circular plate provided to a forward end of the rotating shaft and located in the crushing chamber; annular rotating discs provided on both sides of the circular plate; and fixed discs facing the rotating discs and provided to the cover and the partition, respectively. The refiner further includes a holding member for holding the rotating shaft to be moved along an axis thereof; and a moving member for exposing the circular plate to a side portion of the main portion by moving the holding member along the axis. The cover is openably provided to the main portion through a hinge.

According to a second aspect of the invention, the cover openably provided to the main portion through the hinge includes a supply passage communicating with the crushing chamber.

According to a third aspect of the invention, the cover attached to the main portion includes a discharge passage communicating with the crushing chamber, and a discharge pipe connected to the discharge passage is formed at a side portion of the main portion.

According to a fourth aspect of the invention, a refiner comprises a main portion having a partition; a cover openably attached to the main portion through a hinge and forming a crushing chamber together with the partition; a rotating shaft extending through the main portion to the crushing chamber; a circular plate provided at a forward end of the rotating shaft and located in the crushing chamber; annular rotating discs provided on both sides of the circular plate; and fixed discs facing the rotating discs and provided to the cover and the partition, respectively. When the rotating discs and the fixed discs are exchanged, the cover is opened through the hinge as a supporting point, such that the circular plate is exposed to a side portion of the main portion. Then, the rotating shaft is moved along an axial direction without being disturbed by the cover. Accordingly, the rotating discs provided on both sides of the circular plate and the fixed discs provided to the partition and the cover can be attached or detached easily.

In the first aspect of the invention, when the cover is opened to one side through the hinge as the supporting point, a space is formed in front of the rotating shaft in the axial direction. Therefore, the rotating shaft can be moved in the axial direction without being disturbed by the cover to thereby expose the circular plate to the side portion of the main portion.

Also, since the cover is opened only to one side, a space required for opening and closing the cover is relatively narrow.

In the second aspect of the invention, in addition to the functions of the first aspect, when the cover is opened, a portion for connecting the supply passage and the crushing chamber can be exposed to an outside.

In the third aspect of the invention, in addition to the functions of the first aspect, the cover can be opened or closed in a state where the supply pipe is connected to the main portion.

In the fourth aspect of the invention, when the cover is opened through the hinge as the supporting point, a space is formed in front of the rotating shaft in the axial direction, so that the circular plate can be exposed to the side portion of the main portion by moving the rotating shaft in the axial direction without being disturbed by the cover.

DETAILED DESCRIPTION OF A PREFERRED EMBODIMENT

Figure 1:
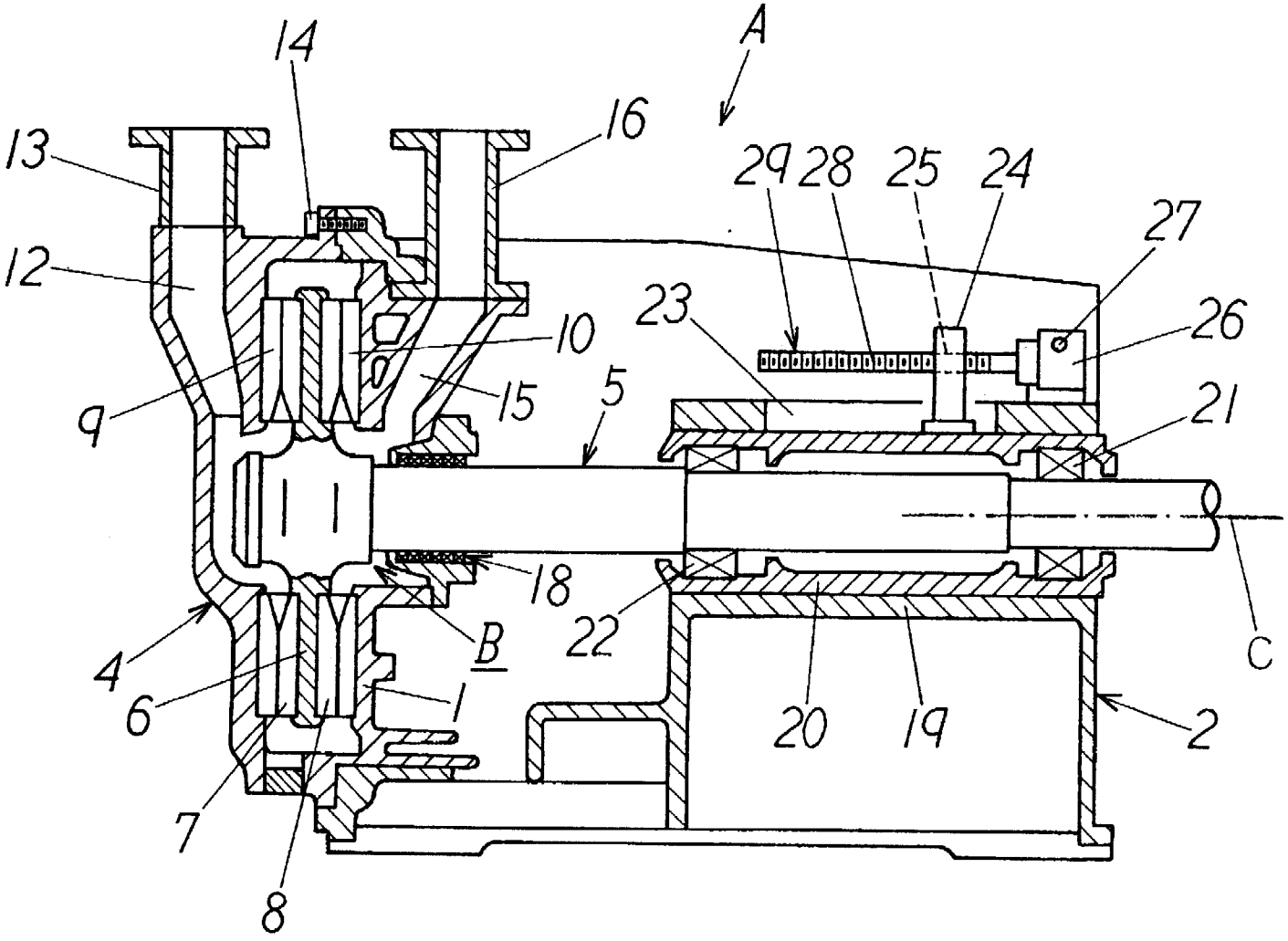
FIG. 1 is a front sectional view of a refiner of an embodiment according to the present invention, wherein a cover is closed.
Figure 2:
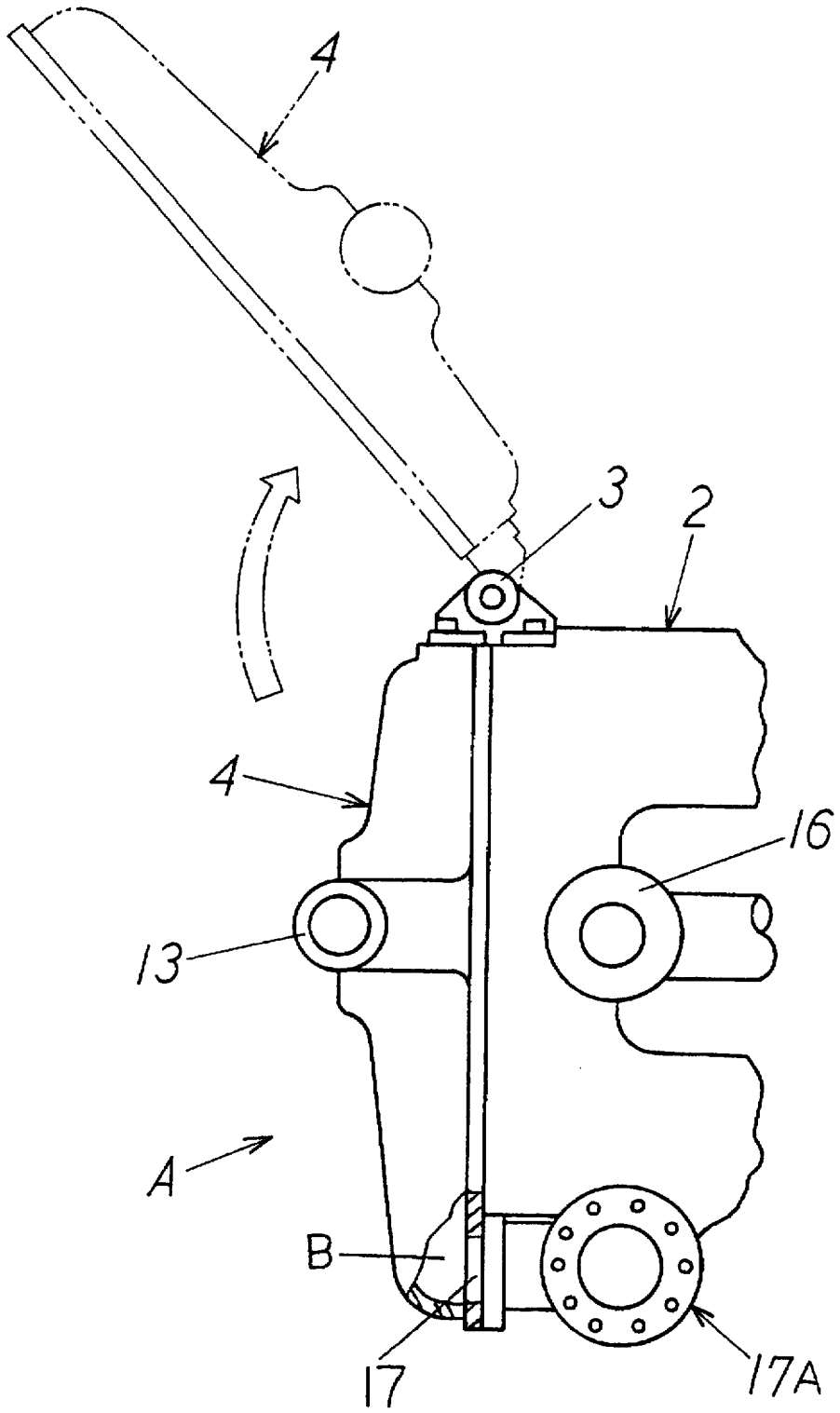
FIG. 2 is a partial plan view thereof.

FIG. 1 is a front sectional view of a refiner A of an embodiment according to the present invention; and FIG. 2 is a partial plan view thereof.

The refiner A is formed of a main portion 2 having a partition 1, and a cover 4 openably provided to the main portion 2 through a hinge 3 to thereby form a crushing chamber B together with the partition 1.

A rotating shaft 5 extending through the main portion 2 to the crushing chamber B has an approximately horizontal axis C. The rotating shaft 5 is provided, at a forward end thereof, with a circular plate 6 located in the crushing chamber B. The circular plate 6 is provided, on both sides thereof, with annular rotating discs 7, 8.

The respective rotating discs 7, 8 are divided into plural portions along their peripheral directions, and fixed to the circular plate 6 by screw members, not shown.

The cover 4 is provided with an annular fixed disc 9 facing the rotating disc 7, and the partition 1 is provided with an annular fixed disc 10 facing the rotating disc 8.

The fixed discs 9, 10 are divided into plural portions along their peripheral directions and are fixed to the cover 4 and partition 1, respectively, by screw members, not shown.

The cover 4 is provided with a supply passage 12 extending from an approximate center of the crushing chamber B to an outside, and a supply pipe 13 connected to the supply passage 12 at an upper portion thereof. Incidentally, the cover 4 is held in a closed state by a bolt 14.

The main portion 2 is provided with a supply passage 15 extending from an approximate center of the crushing chamber B to an outside, and a supply pipe 16 connected to the supply passage 15 at an upper portion thereof. Also, the main portion 2 is provided, on a front side thereof, with a discharge passage 17 communicating with an outer peripheral side of the crushing chamber B, and a discharge pipe 17A connected to the discharge passage 17 on a side portion of the main portion 2.

The discharge pipe 17A is connected to an outer pipe, not shown. Incidentally, a sealing member, such as a gland packing 18, is provided along an inner periphery of the partition 1.

The main portion 2 includes a guiding cylinder 19 and a holding member, such as a cylinder 20, provided movably along a horizontal direction in the guiding cylinder 19. The cylinder 20 is provided with bearings 21, 22 fixed to an inner periphery thereof, and the bearings 21, 22 hold the rotating shaft 5.

The guiding cylinder 19 is provided, at an upper portion thereof, with a slit 23 along a longitudinal direction thereof, and a block 24 fixed to an outer periphery of the cylinder 20 projects upward through the slit 23. The block 24 is provided with an internally threaded hole 25 along a horizontal direction thereof.

The guiding cylinder 19 is provided, at the upper portion thereof, with a case 26, and the case 26 has an operation shaft 27. The operation shaft 27 is provided with a handle, not shown.

The case 26 is provided horizontally, on a side thereof, with an operation member, such as a feed screw shaft 29 having an external thread 28, and the feed screw shaft 29 is screwed into the threaded hole 25. The feed screw shaft 29 is inserted into the case 26 at one end thereof to thereby be operationally connected to the operation shaft 27.

Incidentally, the main portion 2 is provided, at an outer portion thereof, with a motor, not shown, and the rotating shaft 5 is, at one end thereof, connected to the motor through a coupling, not shown.

In the refiner A, a material, such as wood fibers, ground coffee beans, dung or the like, not shown, is fed into the crushing chamber B through the supply passages 12, 15 while rotating the rotating shaft 5.

Then, the material is finely ground in the fine spaces between the rotating disc 7 and the fixed disc 9 and between the rotating disc 8 and the fixed disc 10 to form crushed powder, and the crushed powder is moved toward an outer periphery of the crushing chamber B by a centrifugal force and discharged through the discharge passage 17.

In the present embodiment, when the rotating shaft 5 is stopped and the cover 4 is opened through the hinge 3 as the supporting point as shown by two-dotted lines in FIG. 2, a space is formed on a side portion of the main portion 2. Then, when the operation shaft 27 is rotated to rotate the feed screw shaft 29, the rotating shaft 5 is moved toward a left side in the drawing along the axis C without being disturbed by the cover 4.

Figure 3:
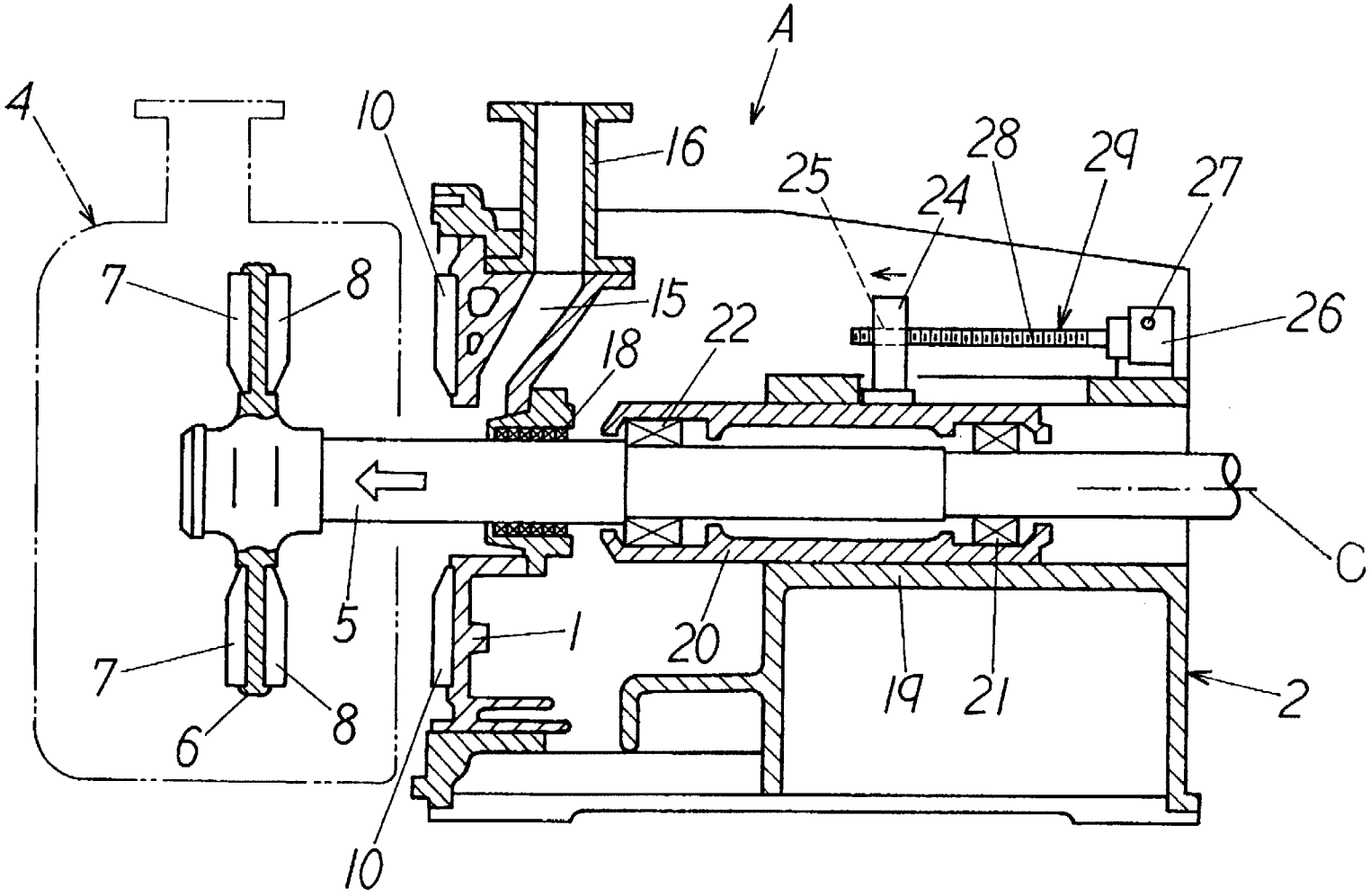
FIG. 3 is a front sectional view thereof, wherein the cover is open.

As a result of the movement of the rotating shaft 5, the circular plate 6 is exposed to the side portion of the main portion 2 as shown in FIG. 3, so that wide spaces are formed between the cover 4 and the circular plate 6 and between the circular plate 6 and the partition 1, respectively, and an operator can easily insert a hand or a tool therebetween.

Therefore, the fixed disc 9 and the rotating disc 7 as well as the fixed disc 10 and the rotating disc 8 can be easily and quickly attached or detached to thereby improve workability at the time of detaching and attaching operations.

Incidentally, a moving amount of the rotating shaft 5 in the direction of the axis C is determined based on a type of the refiner A and dimensions of the rotating discs 7, 8 and fixed discs 9, 10. In the present embodiment, the moving amount is set to about 200 mm in view of workability and structure thereof.

Also, the cover 4 is only opened toward one side of the main portion 2, so that a space required for closing and opening the cover is relatively narrow and even at a narrow space, the attaching and detaching operations can be carried out.

After completion of the attaching and detaching operations, the rotating shaft 5 is again moved toward a right side in the drawing, and the cover 4 is closed. Incidentally, by finely moving the rotating shaft 5 through rotation of the feed screw shaft 29, the fine spaces between the rotating disc 8 and the fixed disc 10 and between the rotating disc 7 and the fixed disc 9 can be adjusted.

Also, in the present embodiment, since one supply passage 12 is provided to the cover 4, when the cover 4 is opened, a connecting portion between the supply passage 12 and the crushing chamber B is exposed outwardly, so that the connecting portion can be easily cleaned.

Further, in the present embodiment, since the discharge pipe 17 is provided to the main portion 2, the cover 4 can be opened or closed while the discharge pipe 17 is connected to the outer pipe to thereby obtain good workability.

Incidentally, only one of the supply passages 12, 15 may be provided. Also, the discharge port of the crushing chamber may be provided to a lower portion of the cover.

Also, as operational members, for example, a rack, not shown, provided to an outer periphery of the cylinder 20 and a pinion, not shown, engaged with the rack may be employed. When the pinion is rotated by a motor, not shown, the rotating shaft 5 may be moved.

As described above, according to the first aspect of the present invention, when the cover is opened through the hinge as the supporting point, since a space is formed in front of the rotating shaft in the axial direction, the rotating shaft can be moved in the axial direction without being disturbed by the cover to thereby expose the circular plate to the side portion of the main portion and to form spaces between the cover and the circular plate and between the circular plate and the partition. Thus, an operator can easily put a hand or a tool thereinto.

Accordingly, attaching and detaching operations of the fixed disc of the cover and the rotating disc facing the fixed disc, as well as the fixed disc of the partition and the rotating disc facing the fixed disc can be easily and quickly carried out to thereby improve workability in the attaching and detaching operations.

Also, since the cover is only opened to one side of the main portion, a space required for opening the cover is relatively narrow, so that the detaching and attaching operations can be carried out even at a narrow space.

Further, different from the conventional refiner, since the discs can be exchanged without removing the circular plate from the rotating shaft, damages of the rotating shaft caused by exchange of the discs can be prevented to thereby prevent lowering of accuracy of the shaft.

According to the second aspect of the present invention, in addition to the advantages obtained in the first aspect of the invention, when the cover is opened, since a connecting portion between the supply passage and the crushing chamber is exposed outwardly, good workability can be obtained in cleaning of the connecting portion.

According to the third aspect of the present invention, in addition to the advantages obtained in the first aspect of the invention, since the cover can be opened or closed while the supply pipe is connected to the main portion, workability in opening and closing of the cover is good.

According to the fourth aspect of the present invention, when the cover is opened to one side through the hinge as the supporting point, a space is formed in front of the rotating shaft in the axial direction. Therefore, the circular plate can be exposed to the side portion of the main portion by moving the rotating shaft in the axial direction without being disturbed by the cover, and the spaces between the cover and the circular plate and between the circular plate and the partition are formed.

Therefore, the fixed disc of the partition and the rotating disc facing the fixed disc can be easily and quickly attached or detached to thereby improve workability of the attaching and detaching operations.

Also, since the cover is opened only to one side portion of the main portion, the space occupied by the refiner is relatively small, and discs can be attached or detached even at a narrow space.

What is claimed is:

1. A refiner comprising, a main portion having a partition at one side, and a guiding cylinder extending laterally therein, said guiding cylinder having a slit at one side along a lateral direction thereof;

a cover having a hinge to be openably attached to the main portion, said cover forming a crushing chamber together with said partition;

a rotating shaft extending through said main portion to said crushing chamber;

a circular plate provided at a forward end of said rotating shaft and located in said crushing chamber;

annular rotating discs provided on both sides of said circular plate, respectively;

fixed discs formed on the cover and the partition, said fixed discs facing said rotating discs;

a holding member situated in the guiding cylinder of the main portion to be moved relative to the guiding cylinder along an axial direction of the rotating shaft, said holding member having bearings therein to rotationally support the rotating shaft inside the holding member; and a moving member attached to the holding member, said moving member being actuated after the cover is opened relative to the main portion so that said circular plate is exposed to a side portion away from the main portion.

2. A refiner according to claim 1, wherein said cover includes a supply passage communicating with said crushing chamber.

3. A refiner according to claim 2, wherein said cover includes a discharge passage communicating with said crushing chamber, and the main portion includes a discharge pipe connected to said discharge passage.

4. A refiner according to claim 3, wherein said moving member includes a block fixed to the cylinder and passing through the guiding cylinder, a feed screw shaft threadably engaging the block, and an actuating device attached to the feed screw shaft, said actuating device being operated to rotate the feed screw shaft to thereby move the rotating shaft in the axial direction thereof.

5. A refiner comprising, a main portion having a partition at one side, and a guiding cylinder extending laterally therein, said guiding cylinder having a slit at one side along a lateral direction thereof;

a cover having a hinge to be openably attached to the main portion, said cover forming a crushing chamber together with said partition;

a rotating shaft extending through said main portion to said crushing chamber;

a circular plate provided at a forward end of said rotating shaft and located in said crushing chamber;

annular rotating discs provided on both sides of said circular plate, respectively;

fixed discs formed on the cover and the partition, said fixed discs facing said rotating discs;

a holding member situated in the guiding cylinder of the main portion to be moved relative to the guiding cylinder along an axial direction of the rotating shaft, said holding member having bearings therein to rotationally support the rotating shaft inside the holding member; and a moving member including a block attached to the holding member and projecting outwardly through the slit in the guiding cylinder, an operation member engaging the block, and an actuating device attached to the operation member, said actuating device being actuated after the cover is opened relative to the main portion so that the holding member for rotationally supporting the rotating shaft is moved inside the guiding cylinder by the operation member engaging the block to thereby move said circular plate to a side portion away from the main portion.

6. A refiner according to claim 5, wherein said operation member is a feed screw threadably engaging the block, and the actuating device is fixed to the guiding cylinder.

7. A refiner according to claim 6, wherein said partition includes a hole with a sealing member so that the rotating shaft extending through the holding member passes through the hole in the partition and is sealed by the sealing member.

* * * * *